United States Patent [19]

Carnahan

[11] 4,010,926

[45] Mar. 8, 1977

[54] ADJUSTABLE PEDESTAL

[76] Inventor: Garnett H. Carnahan, Box J, Nixa, Mo. 65714

[22] Filed: May 26, 1976

[21] Appl. No.: 690,097

[52] U.S. Cl. ..... 248/411; 403/109; 403/366

[51] Int. Cl.[2] ..... F16M 11/00

[58] Field of Search ..... 248/354 C, 407, 408, 248/411, 412, 413; 403/109, 365, 366, 377, 373; 285/305

[56] References Cited

UNITED STATES PATENTS

| | | | |
|---|---|---|---|
| 1,856,149 | 5/1932 | Ball | 248/411 |
| 2,327,990 | 8/1943 | Benson | 403/366 |
| 2,458,714 | 1/1949 | Mahoney | 285/305 X |
| 2,653,839 | 9/1953 | Middendorf | 403/377 X |

*Primary Examiner*—William H. Schultz

[57] ABSTRACT

Upper and lower relatively telescopingly engaged upright support sections are provided and a first of the sections is tubular and telescopingly receives the second section therein. The end portion of the first section into which the second section is telescopingly received includes structure defining an inwardly opening peripherally extending groove segment of generally 180° in angular extent and openings through the first section aligned with the ends of the groove segment and provided with outwardly facing seating surfaces. A generally U-shaped tension member is provided and conforms to and is seated within the groove with the opposite end portions of the tension member projecting through the aforementioned openings. One end portion of the tension member includes a first enlargement thereon seated against the corresponding seating surface and the other end portion of the tension member includes a second enlargement threadedly engaged thereon and seatable against the corresponding seating surface, whereby the tension member may be placed in tension and shifted into position in clamping engagement with the second section of the tubular member.

10 Claims, 3 Drawing Figures

ADJUSTABLE PEDESTAL

BACKGROUND OF THE INVENTION

Various forms of adjustable-type pedestals for tables and seats have been heretofore provided. Examples of previous structures including some of the basic features of the instant invention are disclosed in U.S. Pat. Nos. 1,159,096, 1,309,375, 2,653,839, 2,710,207, 3,014,682 and 3,203,657.

However, the previously known adjustable pedestals and supports are not constructed in a manner so as to provide of ease of adjustment and yet still be of simple construction. Accordingly, a need exists for a structure whereby an adjustable-type pedestal may be provided enabling easy adjustment of the pedestal through the utilization of a low-cost structure.

BRIEF DESCRIPTION OF THE INVENTION

The adjustable pedestal of the instant invention includes a pair of relatively telescopingly engaged tubular members and a single U-shaped clamp, with the clamp supported within an inwardly opening groove of approximately 180° in angular extent formed in the outer tubular member. The larger tubular member includes openings therethrough aligned with the ends of the peripheral groove defined thereby and defining outwardly opening seats against which a fixed abutment carried by one end of the U-shaped member and an adjustable abutment carried by the other end of the U-shaped member are engaged in order to place the U-shaped member in tension and in clamping engagement with the small diameter tubular member telescoped within the larger diameter tubular member from which the U-shaped member is supported.

The main object of this invention is to provide a readily operable adjustable pedestal.

Another object of this invention is to provide an adjustable pedestal specifically designed for use in supporting a seat from a deck portion of a boat.

Yet another object of this invention is to provide a novel clamping structure for relatively telescoped ends of a pair of elongated tubular members.

Still another object of this invention is to provide an adjustable pedestal which may be readily manufactured at low cost.

Another important object of this invention is to provide an adjustable pedestal in accordance with the preceding objects and constructed in a manner whereby one of the telescoped tubular sections thereof may be rotated relative to the other tubular member thereof.

A final object of this invention to be specifically enumerated herein is to provide an adjustable pedestal in accordance with the preceding objects and which will conform to conventional forms of manufacture, be of simple construction and easy to use, so as to provide a device that will be economically feasible, long-lasting and relatively trouble-free in operation.

These together with other objects and advantages which will become subsequently apparent reside in the details of construction and operation as more fully hereinafter described and claimed, reference being had to the accompanying drawings forming a part thereof, wherein like numerals refer to like parts throughout.

DETAILED DESCRIPTION OF THE INVENTION

Figure 1:
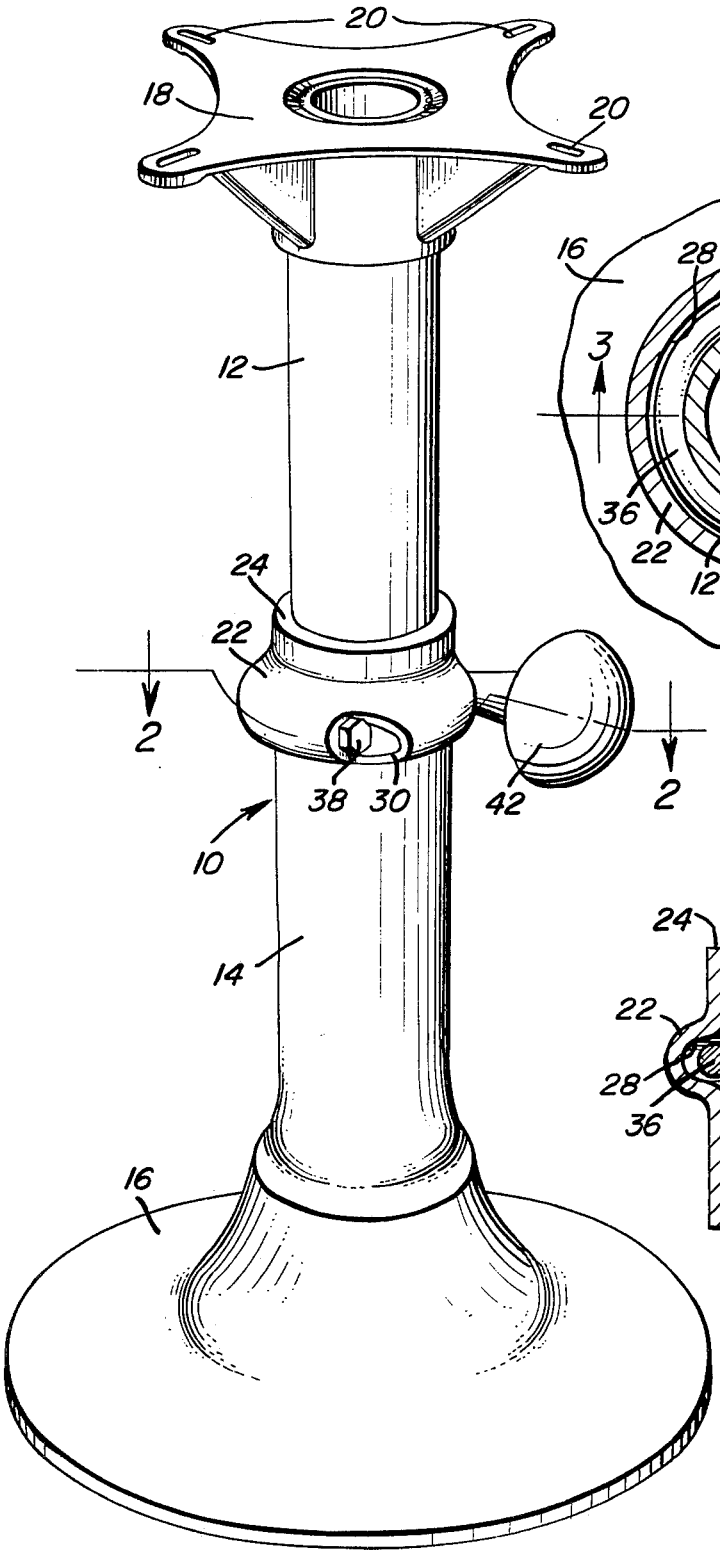
FIG. 1 is a perspective view of a pedestal constructed in accordance with the present invention.

Referring now more specifically to the drawings, the numeral 10 generally designates the adjustable pedestal of the instant invention. The pedestal 10 includes telescopingly engaged upper and lower tubular cylindrical sections 12 and 14. The tubular section 14 is of an inside diameter slightly greater than the outside diameter of the upper tubular section 12 and includes a flared base 16 which may be secured, in any convenient manner, to a horizontal supporting surface. Further, the upper end of the upper smaller diameter tubular section 12 includes a mounting structure 18 to which a suitable seat structure (not shown) may be secured by means of fasteners secured through upstanding openings 20 formed in four peripherally spaced portions of the mounting structure 18.

Figure 2:
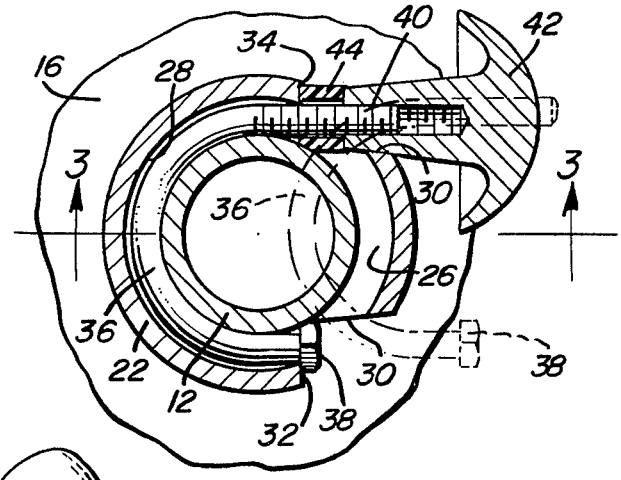
FIG. 2 is an enlarged fragmentary horizontal sectional view taken substantially upon the plane indicated by the section line 2—2 of FIG. 1.
Figure 3:
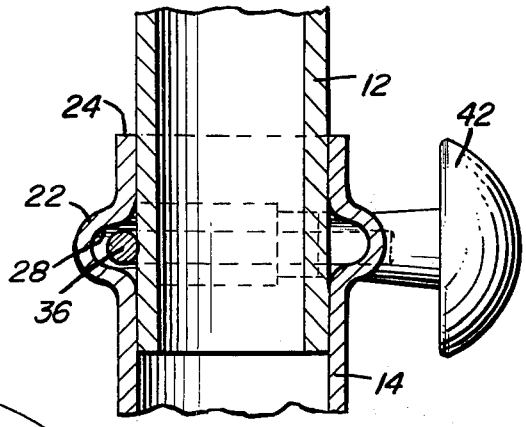
FIG. 3 is a fragmentary, vertical sectional view taken substantially upon the plane indicated by the section line 3—3 of FIG. 2.

With attention now invited more specifically to FIGS. 1 and 2 of the drawings, it may be seen that the upper end portion of the lower larger diameter tubular section 14 includes a diametrically enlarged portion 22 spaced from the upper terminal end 24 of the lower tubular section 14.

The diametrically enlarged portion 22 defines an inwardly opening and peripherally extending groove 26 and the groove 26 includes a first segment 28 thereof which is approximately 180° in angular extent. The diametrically enlarged portion 22 is notched as at 30 in order to define openings formed through the tubular section 14 in alignment with the opposite ends of the segment 28 of the groove 26 and the notched portions 30 further define outwardly opening seats 32 and 34 extending about the aforementioned openings.

A generally U-shaped clamp member 36 is provided and conforms to and is received within the segment 28 of the groove 26 with the opposite end portions of the U-shaped clamp member 36 projecting outwardly beyond the seats 32 and 34. The end of the clamp member 36 which projects outwardly beyond the seat 32 includes a fixed enlargement 38 thereon seated against the seat 32 and the other end of the clamp member 36 is externally threaded as at 40 and has a hand nut 42 threaded thereon behind a plastic sleeve 44 telescoped on the threaded end portion 40 and abutted against the seat 34.

The inner peripheral surfaces of the U-shaped clamp member snugly embrace the opposing outer surfaces of the lower end of the tubular section 12 and upon tightening of the hand nut 42 on the associated end of the clamp member 36, the latter will be tensioned and drawn into tight clamping engagement with the lower end portion of the tubular section 12 telescoped into the upper end of the tubular section 14. The clamping action of the clamp member 36 on the tubular section 12 is sufficient to lock the tubular section 12 against axial displacement relative to the tubular section 14 and also against angular displacement relative to the tubular section 14, the tubular section 12 being readily longitudinally shiftable and rotatable relative to the tubular section 14 when the hand nut 42 is loosened.

It will also be appreciated that when the hand nut 42 is removed from threaded engagement with the clamp member 36 and the plastic sleeve 44 is slipped from the corresponding end of the clamp member 36, the latter may be shifted to the phantom line position thereof illustrated in FIG. 2 of the drawings and then rotated in a counterclockwise direction about the central curvature of the curved portion of the clamp member 36 in order to completely disengage the clamp member 36 from the tubular section 14 by axially displacing the threaded end of the clamp member 36 inwardly through the adjacent notched portion 30 of the diametrically enlarged portion 22 and thereafter outwardly of the other notched portion 30 of the diametrically enlarged portion 32. However, the upper tubular section 12 must first be removed from telescoped engagement within the tubular section 14 before the clamp member 36 may be removed.

It is also pointed out that the clamp-type connection between the tubular section 12 and 14 may be used in other environments wherever an adjustable length elongated member is desired.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An adjustable height pedestal including upper and lower relatively telescopingly engaged upright support sections, one of said sections being tubular and telescopingly receiving the other section in one end portion thereof, said one end portion of said other section including means defining an inwardly opening peripherally extending groove segment of at least 90° in angular extent and openings through said one end portion aligned with the ends of said groove segment and provided with outwardly facing seating surfaces, and an elongated tension member of a configuration conforming to and received in said groove and provided with opposite end portions projecting outwardly through said openings, one of said tension member end portions including a first enlargement thereon seated against the corresponding seating surface and the other tension member end portion including a second enlargement thereon shiftable therealong and engageable with the corresponding seating surface for placing said tension member in tension and shifting the tension member into clamping engagement with said other support section.

2. The combination of claim 1 wherein said peripherally extending groove is of generally 180° in angular extent.

3. The combination of claim 1 wherein said sections are generally cylindrical in configuration and relatively rotatable as well as axially shiftable when the tension on said tension member is released.

4. The combination of claim 1 wherein said first enlargement comprises an integral head carried by said one end portion of said tension member.

5. The combination of claim 1 wherein said groove is generally U-shaped in cross-sectional shape.

6. The combination of claim 5 wherein said tension member is circular in cross-sectional shape and fully receivable in said groove.

7. The combination of claim 6 wherein said peripherally extending groove is of generally 180° in angular extent.

8. The combination of claim 7 wherein said sections are generally cylindrical in configuration and relatively rotatable as well as axially shiftable when the tension on said tension member is released.

9. The combination of claim 1 wherein said one end portion of said other section includes a diametrically enlarged portion in which said groove is defined.

10. In combination with a pair of elongated sections, one of said sections being tubular and telescopingly receiving the other section in one end portion thereof, said one end portion of said other section including means defining an inwardly opening peripherally extending groove segment of at least 90° in angular extent and openings through said one end portion aligned with the ends of said groove segment and provided with outwardly facing seating surfaces, and an elongated tension member of a configuration conforming to and received in said groove and provided with opposite end portions projecting outwardly through said openings, one of said tension member end portions including a first enlargement thereon seated against the corresponding seating surface and the other tension member end portion including a second enlargement thereon shiftable therealong and engageable with the corresponding seating surface for placing said tension member in tension and shifting the tension member into clamping engagement with said other support section.

* * * * *